US009261256B2

(12) United States Patent
Coury

(10) Patent No.: US 9,261,256 B2
(45) Date of Patent: Feb. 16, 2016

(54) STAR LIGHTING FIXTURE

(71) Applicant: 3form, Inc., Salt Lake City, UT (US)

(72) Inventor: James Andrew Coury, Seattle, WA (US)

(73) Assignee: 3Form, LLC, Salt Lake City, UT (US)

( * ) Notice: Subject to any disclaimer, the term of this patent is extended or adjusted under 35 U.S.C. 154(b) by 14 days.

(21) Appl. No.: 14/203,318

(22) Filed: Mar. 10, 2014

(65) Prior Publication Data

US 2014/0268686 A1 Sep. 18, 2014

Related U.S. Application Data

(60) Provisional application No. 61/780,438, filed on Mar. 13, 2013.

(51) Int. Cl.

| | |
|---|---|
| ***F21S 8/04*** | (2006.01) |
| ***F21V 1/12*** | (2006.01) |
| *F21S 8/06* | (2006.01) |

(52) U.S. Cl.

CPC .... *F21V 1/12* (2013.01); *F21S 8/06* (2013.01); *Y10T 29/49716* (2015.01); *Y10T 29/49826* (2015.01)

(58) Field of Classification Search

None

See application file for complete search history.

(56) References Cited

U.S. PATENT DOCUMENTS

| | | | | |
|---|---|---|---|---|
| 7,473,015 | B1 * | 1/2009 | Chen | 362/367 |
| 8,572,833 | B2 * | 11/2013 | Ly et al. | 29/509 |
| 2009/0296048 | A1 * | 12/2009 | Hong | 353/62 |

FOREIGN PATENT DOCUMENTS

DE 102010040712 A1 * 3/2012

* cited by examiner

*Primary Examiner* — Britt D Hanley

(74) *Attorney, Agent, or Firm* — Workman Nydegger

(57) ABSTRACT

Systems, methods, and apparatus for illumination and/or providing an aesthetically pleasing lighted structure can include a hollow core with a plurality of cover panels mounted radially thereto. In at least one implementation, a lighting fixture can incorporate a lighted core and lighted or unlighted elements surrounding the lighted core. Furthermore, the lighted core can house lighting elements, while providing substantially unimpeded access thereto.

22 Claims, 10 Drawing Sheets

STAR LIGHTING FIXTURE

CROSS-REFERENCE TO RELATED APPLICATIONS

The present application claims the benefit of priority to U.S. Provisional Patent Application No. 61/780,438, filed Mar. 13, 2013, entitled "Star Lighting Fixture," the entire content of which is incorporated by reference herein.

BACKGROUND OF THE INVENTION

1. The Field of the Invention

Implementations of the present invention relate to decorative resin lighting fixtures.

2. Background and Relevant Art

Recent trends in building design involve using one or more sets of decorative panels to add to the functional and/or aesthetic characteristics of a given structure or design space. These recent trends are due, at least in part, because there is sometimes more flexibility with how the given panel (or set of panels) is designed, compared with the original structure. For example, recent panel materials include synthetic, polymeric resin materials, which can be formed as panels to be used as partitions, walls, barriers, treatments, décor, etc.

In particular, the use of resin materials is becoming increasingly popular in sculptural and lighting applications. In general, resin materials such as these are now popular compared with decorative cast or laminated glass materials, since resin materials may be manufactured to be more resilient and to have a similar transparent, translucent, or decorative appearance as cast or laminated glass, but with less cost. In addition, resin materials tend to be more flexible in terms of manufacture and assembly because they can be relatively easily bent, molded, colored, shaped, cut, and otherwise modified in a variety of different ways. Decorative resins can also provide more flexibility compared with glass and other conventional materials at least in terms of color, degree of texture, gauge, and impact resistance. Additionally, decorative resins have a fairly wide utility since they may be formed to include a large variety of colors, images, inter-layers, and shapes.

Unfortunately, some lighting fixtures made with resin materials are designed to allow for quick, efficient, and inexpensive production. The design of such resin-based lighting fixtures may not focus on, or even allow for, full utilization of the aesthetics that resin-based materials can provide. Along similar lines, many resin-based lighting fixtures are designed for mass production. Mass produced resin-based lighting fixtures, while being relatively inexpensive, can lack uniqueness. Other lighting fixtures made with resin materials are so unique that they typically cannot be mass produced on any appreciable level without, making such unique lighting fixtures costly.

Furthermore, some lighting fixtures made with resin materials do not deliver appropriate light distribution. An inappropriate light distribution, however, can emphasize particularly unappealing features and fail to provide sufficient emphasis on certain desirable features of the lighting fixture and/or of the surrounding area. Moreover, at times, the lighting fixtures can have cumbersome or complicated configurations, which can present various maintenance challenges, including but not limited to re-lamping the lighting fixture. For example, in some instances, the user of the lighting fixture may have to at least partially disassemble the lighting fixture in order to access and change lighting elements thereof.

Accordingly, there are a number of disadvantages in resin-based lighting fixtures that can be addressed.

BRIEF SUMMARY OF THE INVENTION

Implementations of the present invention provide systems, methods, and apparatus for illumination and/or providing an aesthetically pleasing lighted structure. In particular, at least one implementation involves a lighting fixture that can incorporate a lighted core and lighted or unlighted elements surrounding the lighted core. Furthermore, the lighted core can house lighting elements, while providing substantially unimpeded access thereto. Additionally, one or more implementations also include methods of manufacturing the lighting fixture, such as to achieve a desirable aesthetic thereof.

For example, one implementation of a resin-based lighting fixture configured for simple assembly and redesign can include a lighted hollow core having an outer surface, a plurality of slots in an upper portion thereof, and a plurality of channels in a lower portion thereof. The lighting fixture can also include a plurality of removable cover panels disposed about the outer surface of the hollow core. The plurality of cover panels conceal the hollow core and provide an aesthetic design to the hollow core. In addition, the lighting fixture can include a lighting element located inside the lighted core. In this case, each cover panel of the plurality can comprise at least one upper mounting tab and at least one lower mounting tab that correspondingly engage one of the slots in the upper portion or one of the channels in the lower portion, to thereby attach the cover panel to the lighted hollow core.

An additional or alternative resin-based lighting fixture can include a tubular frame comprising a tubular support having a plurality of slots formed in an upper portion thereof. The resin-based lighting fixture can also include a plurality of resin-based cover panels coupled to and about the tubular frame, the resin-based cover panels at least partially concealing the tubular frame and providing a removable design aesthetic to the tubular frame. In addition, the resin-based lighting fixture can include a lighting element located inside the tubular frame. In this case, each resin-based cover panel can comprise at least one upper mounting tab configured to fit within a slot in the upper portion of the tubular frame. Furthermore, each of the resin-based cover panels can comprise a tab that is approximately perpendicular to the corresponding upper mounting tab, and that diffuses light emanating from the tubular frame.

Furthermore, a method for manufacturing a lighting fixture with a variable design aesthetic can include forming a frame having an upper portion and a lower portion. The method can also include forming a plurality of slots for use in the upper portion, wherein the plurality of slots is formed to align circumferentially along the upper portion of the frame. In addition, the method can include forming two-dimensional blank cutouts from sheet material. Furthermore, the method can include shaping the two-dimensional blank cutouts into three-dimensional resin-cover panels that comprise at least one upper mounting tab. Still further, the method can include securing a first of the shaped resin-cover panels to the frame by inserting the upper mounting tab of the formed resin-cover panel into at least one of the formed slots.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention provide systems, methods, and apparatus for illumination and/or providing an aesthetically pleasing lighted structure. In particular, at least one implementation involves a lighting fixture that can incorporate a lighted core and lighted or unlighted elements surrounding the lighted core. Furthermore, the lighted core can house lighting elements, while providing substantially unimpeded access thereto. Additionally, one or more implementations also include methods of manufacturing the lighting fixture, such as to achieve a desirable aesthetic thereof.

Implementations of the present invention can provide aesthetically pleasing lighting fixtures that are complex while being relatively simple to assembly. For instance, one or more implementations can include resin-based lighting fixtures that may have hand-shaped elements, forming aesthetically pleasing configurations. Furthermore, the resin-based lighting fixtures can help magnify the aesthetic features of the resin materials used to form the lighting fixtures. Indeed, one or more implementations may help magnify the form, texture, color(s), transparency, and other features of the resin materials.

In at least one implementation, the resin-based lighting fixtures can comprise a frame that can support decorative and/or functional lighting fixture elements. For instance, the frame of the lighting fixture can support one or more resin-cover panels and one or more lighting elements that can illuminate the resin-based lighting fixture as well as provide illumination to a surrounding area. Furthermore, the resin-based cover panels can define the overall shape of the resin-based lighting fixture and can at least partially conceal the core thereof.

Figure 1A:
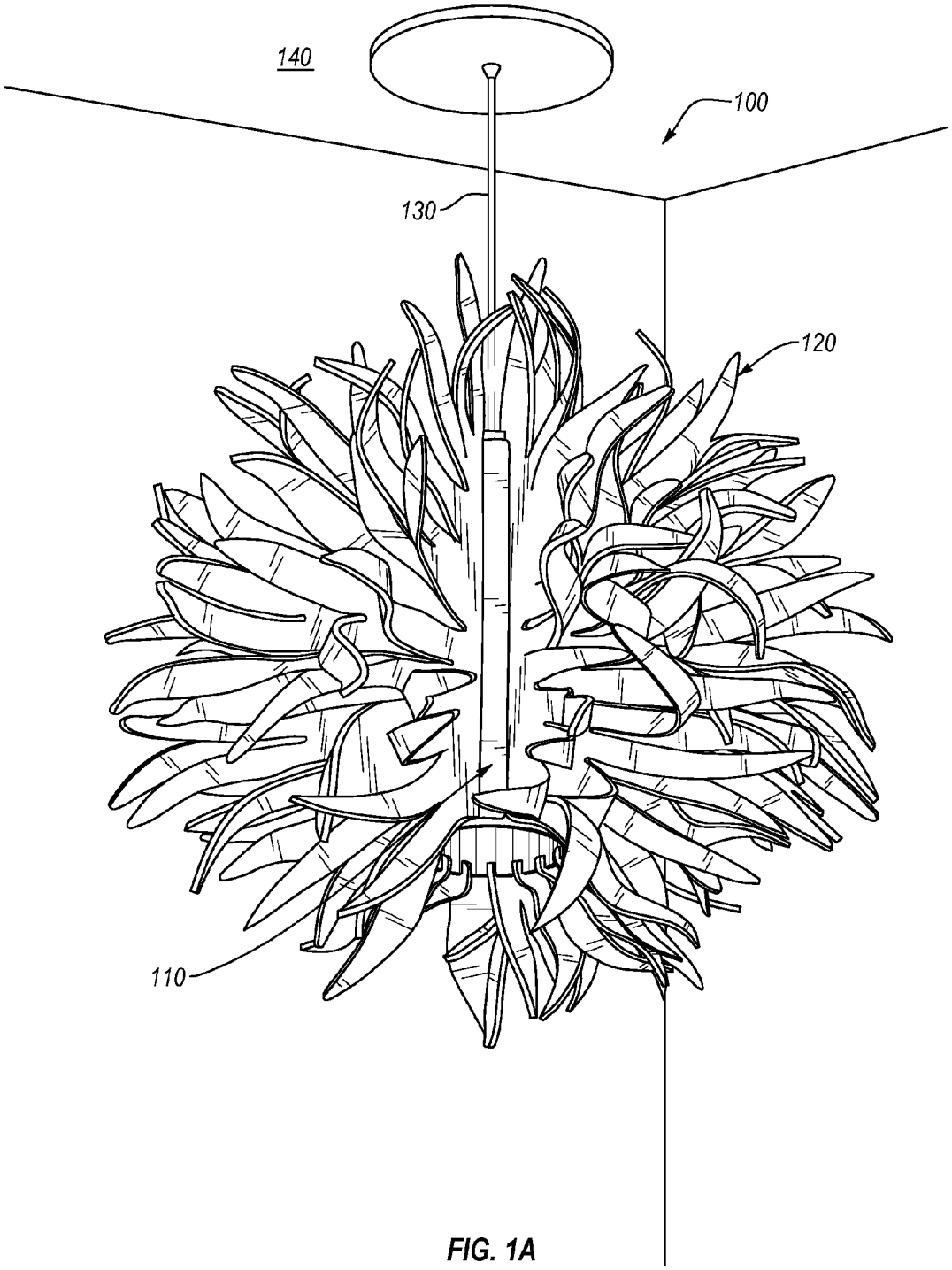
FIG. 1A illustrates a perspective view of a resin-based lighting fixture in accordance with one implementation of the present invention.
Figure 1B:
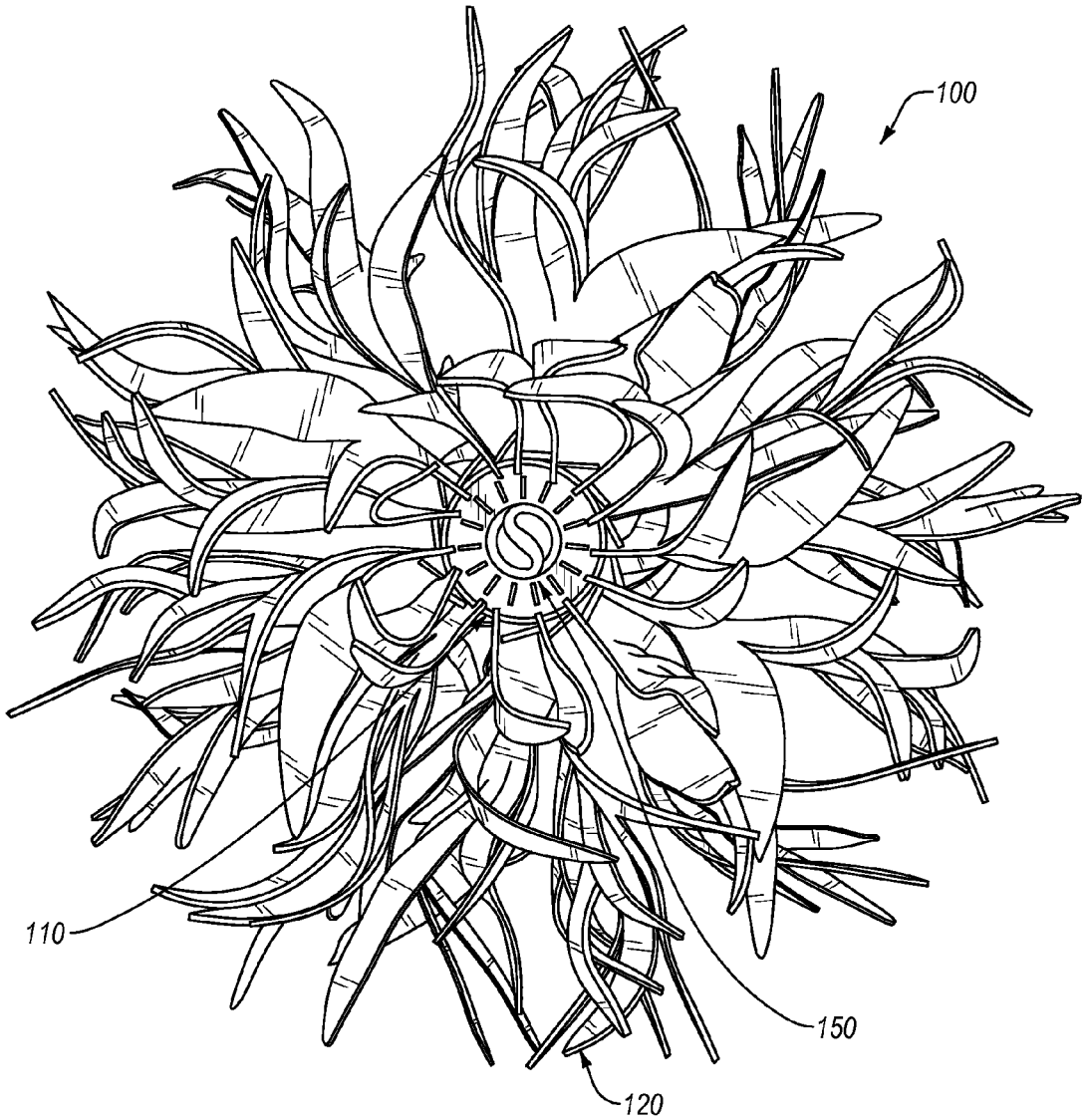
FIG. 1B illustrates a bottom view of the resin-based lighting fixture of FIG. 1A.

Turing now to the Figures, FIGS. 1A-1B illustrate an exemplary implementation of a resin-based lighting fixture. Particularly, FIG. 1A illustrates a bottom perspective view of a resin-based lighting fixture 100. In particular, FIG. 1A shows that the resin-based lighting fixture 100 can include a lighted core 110 and a plurality of fins 120 positioned about the lighted core. The lighted core 110 can comprise a frame (160, see also FIG. 2A) and/or a diffuser, which can at least partially surround the frame.

As described below in more detail, in one or more implementations, resin-based cover panels can incorporate the fins 120 as well as multiple tabs (190, FIG. 2A) that can surround the frame 160. The tabs, collectively, can form the diffuser of the lighted core 110. As also discussed herein, the diffuser can comprise other components in addition to or in alternative to the tabs 190. In addition, as further discussed herein, the fins 120 can comprise any number of shapes, sizes, or orientations. Additionally or alternatively, the frame also can incorporate a separate diffuser (not shown) or a portion thereof, that is different from the tabs 190.

The frame 160 can secure the fins 120 as well as other decorative elements or components of the resin-based lighting fixture 100. For instance, the frame also can secure a mounting cable 130, which can secure the resin-based lighting fixture 100 to a support surface 140. In at least one implementation, the mounting cable 130 also can have an integrated power cable, which can supply electrical power to the lighting elements within the resin-based lighting fixture 100.

As illustrated in FIG. 1B, the resin-based lighting fixture 100 can incorporate a single lighting element 150, which can illuminate the lighted core 110 as well as the area surrounding the resin-based lighting fixture 100. It should be appreciated, however, that the resin-based lighting fixture 100 can incorporate any number of lighting elements 150, which can vary from one implementation to the other (e.g., two, three, four, etc.). Furthermore, the lighting element 150 can have any number of suitable arrangements within the lighted core 110 of the resin-based lighting fixture 100, such that the lighting element 150 can illuminate the lighted core 110 and/or the area surrounding the resin-based lighting fixture 100.

The lighting elements 150 also can include any type of element capable of producing visible light. For example, lighting elements 150 can comprise incandescent, fluorescent (e.g., CFL), and/or LED light bulbs. The lighting elements 150 also can include neon or other strip lights, as well as other lighting elements 510 configurations.

Moreover, the user may have easy access to the lighting element 150 (e.g., for re-lamping the resin-based lighting fixture 100). For example, the frame and or the lighted core 110 can have an open bottom, which can allow the user to access the lighting element 150 without disassembly of the resin-based lighting fixture 100 and/or without removal of any components or elements therefrom. Avoiding disassembly of the resin-based lighting fixture 100 can help ensure that the resin-based lighting fixture remains undamaged during and after the re-lamping thereof.

As noted above, the resin-based lighting fixture 100 can include the diffuser surrounding the frame of the resin-based lighting fixture 100. In particular, the diffuser can diffuse the light generated by the lighting element 150 in a manner that provides a substantially uniform illumination of the lighted core 110. Additionally or alternatively, the diffuser also can diffuse the light from the lighting element 150 over the area surrounding the resin-based lighting fixture 100 in a substantially uniform manner. In other words, the diffuser can spread or diffuse light generated by the lighting element 150 across a surface or an area, instead of appearing to the viewer concentrated at one or more locations. Such diffusion can create a desirable aesthetic appeal for the resin-based lighting fixture 100 as well as for the area lighted and/or decorated by the resin-based lighting fixture 100.

Furthermore, the diffuser can have various textures and/or formations on one or more surfaces of the frame and/or the tabs of the resin-based cover panels, which can enhance the diffusive properties of the diffuser. For example, the manufacturer can sand the surface of the frame and/or of the tabs or segments thereof with fine sandpaper, to create a matte or dull surface. Additionally or alternatively, the manufacturer can form single- or multi-faceted depressions and/or protrusions on one or more surfaces of the thermoplastic resin sheet(s) or segments that from the diffuser.

In one or more implementations, the frame and/or the tabs that form the diffuser can at least partially comprise one or more thermoplastic resin sheets. The term "resin," as used herein, refers to panels, strips, sheets, and/or other two- or three-dimensional configurations comprising one or more thermoplastic polymers. Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), or the like.

Moreover, in at least one implementation, the manufacturer can wrap a diffuser sheet (not shown) around the frame. For instance, the diffuser sheet can be a translucent sheet of material (e.g., thermoplastic material, translucent suede, etc.). As such, the diffuser can be a separate component of the resin-based lighting fixture 100 (i.e., a component not incorporated into any other component).

In one or more implementations, the fins 120 can remain at least partially unlit. Additionally or alternatively, the lighting element 150 can partially illuminate the fins 120. For example, the lighting element 150 can illuminate the fins 120 such as to produce a light gradient across the fins 120—wherein the portion closest to the lighted core 110 has the most illumination, and the portion farthest from the lighted core 110 has the least amount of illumination. In any event, the unlit portions of the fins 120 can provide a contrast against the illuminated lighted core 110, which can have a pleasing aesthetic.

The frame of the resin-based lighting fixture 100 can at least partially define the shape and size of the resin-based lighting fixture 100. Implementations of the present invention, however, can include the fins 120 that can at least partially define the shape of the resin-based lighting fixture 100. In other words, as further described below, the fins 120 can mask the shape of the frame in a manner that the resin-based lighting fixture 100 appears to have a shape that is different from the shape of the frame. For example, the frame can have a substantially cylindrical shape, while the fins 120 can have a shape, size, or orientation that otherwise masks the cylindrical shape of the frame in a manner that the resin-based lighting fixture 100 appears to have an approximately spherical shape.

Figure 2A:
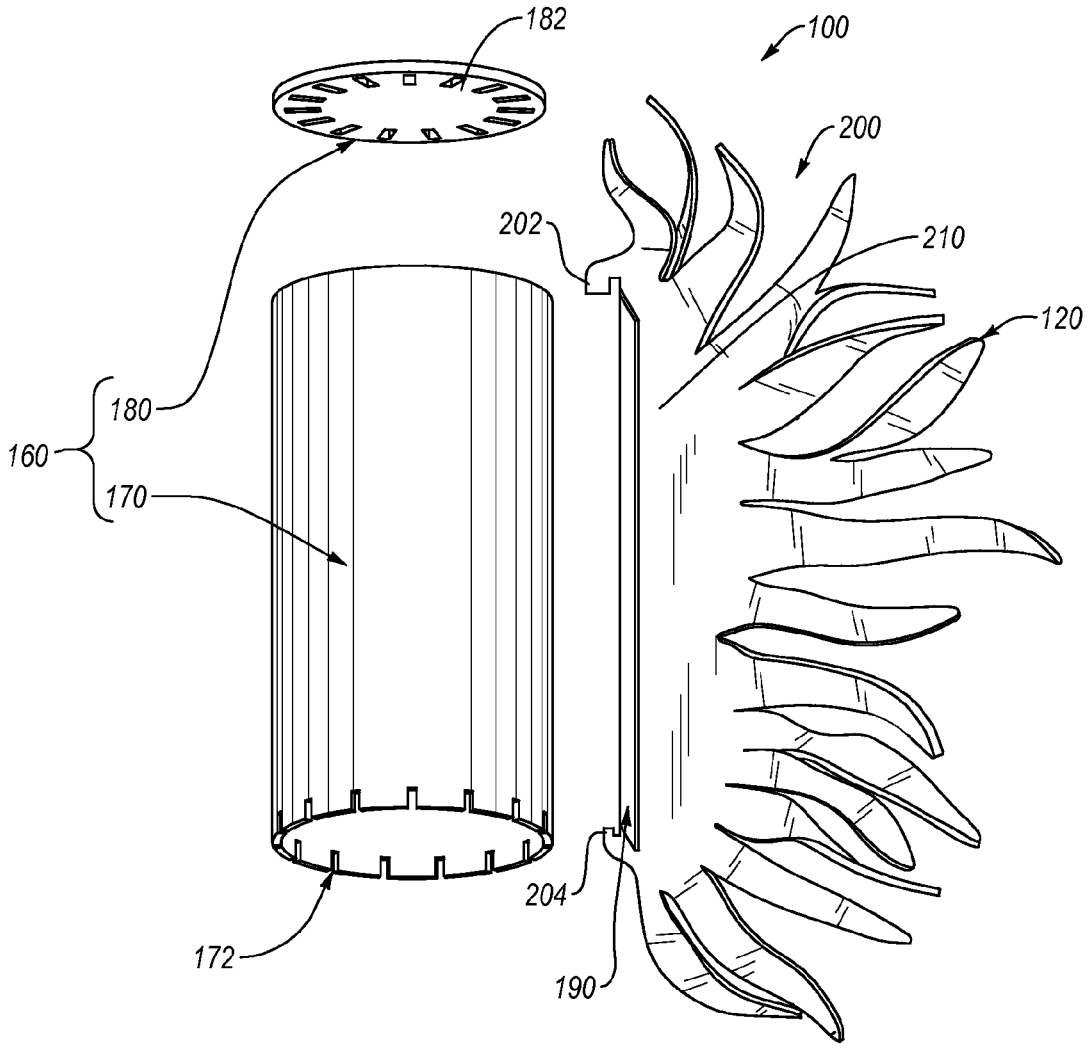
FIG. 2A illustrates an exploded perspective view of components of the resin-based lighting fixture of FIG. 1A.
Figure 2B:
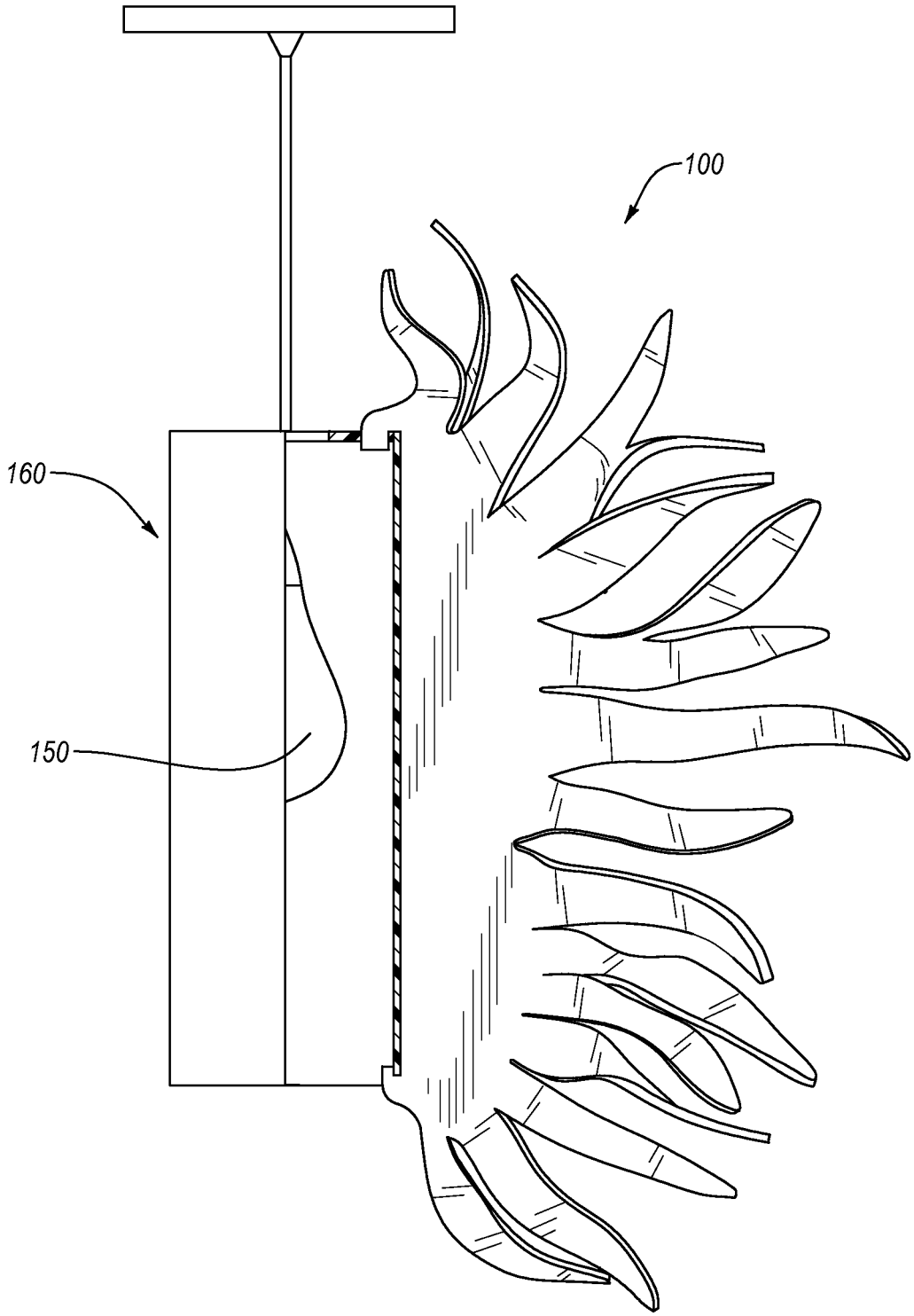
FIG. 2B illustrates a partial cross-sectional view of a partially assembled resin-based lighting fixture of FIG. 1A.

For example, as illustrated in FIGS. 2A-2B, the resin-based lighting fixture 100 can have a cylindrical frame 160. Particularly, as illustrated in FIG. 2A, the frame 160 can comprise a substantially cylindrical, tubular support 170 and a slotted cap 180. More specifically, the slotted cap 180 can couple to and inside of the tubular support 170. For instance, the manufacturer can weld, glue, and/or fasten (e.g., with screws, rivets, etc.) the slotted cap 180 near a top end of the tubular support 170. Thus, the slotted cap 180 can at least partially close the top of the tubular support 170 as well as provide additional strength and/or structural rigidity thereto.

It should be appreciated that the frame 160 can be substantially solid, such that the tubular support 170 and/or the slotted cap 180 comprises a single element. In other words, the tubular support 170 and the slotted cap 180 may not have multiple interconnected elements that together form the frame 160. Alternatively, however, the frame 160 can comprise multiple interconnected and/or spaced apart elements (e.g., bars, rods, etc.), which can together form an open frame.

Moreover, while comprising a single, solid element, the frame 160 can also be hollow or tubular. In other words, the frame 160 can have a hollow cavity formed therein. Hence, as noted above, the resin-based lighting fixture 100 can have a configuration that allows the user to easily and readily access the lighting element 150 without disassembling the resin-based lighting fixture 100. For example, the user may access the hollow cavity of the frame 160, which can house the lighting element 150, from the bottom of the frame 160. That is, the tubular support 170 can be hollow, and the bottom of the frame 160 can remain open, such that the user can reach into the cavity of the frame 160 to remove and/or replace the lighting element 150.

In one or more implementations of the present invention, the tubular support 170 can comprise a thermoplastic resin sheet or panel folded or bent to form a substantially tubular support 170. Additionally, the manufacturer can weld, glue, and/or fasten the edges of the vent thermoplastic resin sheet, to form a substantially uniformly tubular support 170. As noted above, in at least one instance, the manufacturer can glue or weld the slotted cap 180 to the tubular support 170. Hence, the slotted cap 180 can secure opposing ends of the thermoplastic resin sheet and maintain the tubular shape of the tubular support 170. In any event, the tubular support 170 can be a single, hollow element that at least in part forms the frame 160.

As noted above, a resin-based cover panel 200 that comprises the fins 120 (which, in the illustrated case, extend from flat portion 210) also can incorporate a tab 190. In other words, the resin-based cover panel 200 can incorporate at least the decorative fins 120, and the tab 190, which can couple together as a single unit to the frame 160. In one or more instances, the tab 190 can have a substantially linear or flat configuration along a longitudinal axis of the resin-based cover panel 200. Additionally or alternatively, the resin-based cover panel 200 also can include a flat portion 210 that, when coupled to the frame 160, can protrude radially outward relative to a center axis of the frame 160.

The tab(s) 190 can have a nonparallel orientation relative to the flat portion 210. Specifically, as further described below, the manufacturer can bend the thermoplastic resin sheet in a manner that the tab 190 forms an acute or obtuse angle with respect to the flat portion 210. In additional or alternative implementations, the resin-based cover panel 200 can have the tab 190 and flat portion 210 in a substantially perpendicular orientation relative to each other.

The tabs 190 of multiple resin-based cover panels 200 can at least partially conceal the frame 160. Accordingly, the manufacturer can use the same frame 160 for any number of different resin-based lighting fixtures 100, while varying color, shape, transparency/translucency, and design of the tabs 190, thereby producing distinct resin-based lighting fixtures 100. Moreover, the tabs 190 can allow the manufacturer to precisely locate the resin-based cover panels 200 around the frame 160. More specifically, the tabs 190 can set and control a predetermined spacing between adjacent resin-based cover panels 200 (i.e., the tab 190 also can be a spacer).

The resin-based cover panel 200 can couple to the frame 160 in any number of suitable arrangements that can vary from one implementation to the next. In one implementation, the frame 160 can have multiple connection slots and/or channels on opposing ends thereof, which can accept and secure corresponding portions of the resin-based cover panel 200. For example, FIG. 2A shows that the frame 160 can have slots 182 in the slotted cap 180 thereof, which is positioned in an upper portion of the frame 160, and channels 172 formed in a lower portion in the tubular support 170 thereof. In at least one implementation, channels 172 can be formed directly in the lower portion of frame 160, whereas slots can be formed in a removable cap (e.g., 180).

Specifically, the frame 160 can have radially arranged slots 182 (e.g., formed within cap 180) and channels 172. Or, rather than specifically radially, the slots can be arranged along a circumference of an upper portion of the frame 160. For instance, the slots 182 can be directly above and in line with the channels 172 (which are also either radially aligned, or otherwise circumferentially aligned), such that a reference line formed between the slots 182 and channels 172 can be substantially parallel to a center axis of the frame 160. Moreover, radial and/or circumferential arrangement of the slots 182 and channels 172 about the frame 160 can allow the manufacturer to secure multiple resin-based cover panels 200 (having any orientation or design, including design of fins 120) on and about the frame 160 in a radial and/or circumferential arrangement. Of course, one will appreciate that, a manufacturer can configure the upper portion and lower portion so that the slots or channels are formed respectively in a removable cap in either or both portions. Similarly, the manufacturer can configure the upper portion and lower portion so that the slots or channels are formed respectively directly in the upper or lower portion of the frame 160 (and/or tubular support 170).

Additionally, the resin-based cover panels 200 can have mounting tabs 202, 204 on respective upper and lower portions thereof. The mounting tabs 202, 204 can have size, shape, and configuration such as to fit inside the respective slots 182 and channels 172. Accordingly, the manufacturer can secure the resin-based cover panel 200 to the frame 160 by inserting the mounting tabs 202 and the 204 into the respective slots 182 and channels 172 of the frame 160.

Furthermore, to avoid unintentional detachment or decoupling of the resin-based cover panels 200 from the frame 160, the manufacturer can glue, weld, and/or fasten the resin-based cover panels 200 at or near the top and/or the bottom of the frame 160. For example, the manufacturer can glue or weld the mounting tabs 202, 204 within respective slots 182 and/or channels 172. As noted above, once secured to the frame 160, the multiple resin-based cover panels 200 can define a shape that is different than the shape of the frame 160. For instance, the resin-based cover panels 200 can define a substantially spherical shape (by virtue of arrangement and alignment of the outer edges, or fins) of the resin-based lighting fixture 100.

Such configuration of the resin-based lighting fixture 100 can allow the manufacturer or installer to quickly and easily assemble the resin-based lighting fixture 100. Furthermore, ease of assembly can allow the manufacturer to supply a kit for assembly by the user or installer. In other words, the manufacturer can produce and provide a kit (e.g., for a custom resin-based lighting fixture) that incorporates assembly components, as described above, and the user can assemble the kit into the custom resin-based lighting fixture.

In light of this disclosure, it should be appreciated that the resin-based cover panels 200 can have multiple layers. For instance, the resin-based cover panels 200 can comprise multiple thermoplastic resin sheets laminated together. Furthermore, one or more of the resin-based cover panels 200 also can include an interlayer between the laminated thermoplastic resin sheets. In one example, such interlayer can comprise decorative objects visible through at least one of the thermoplastic resin sheets that form the resin-based cover panel 200.

Figure 3:
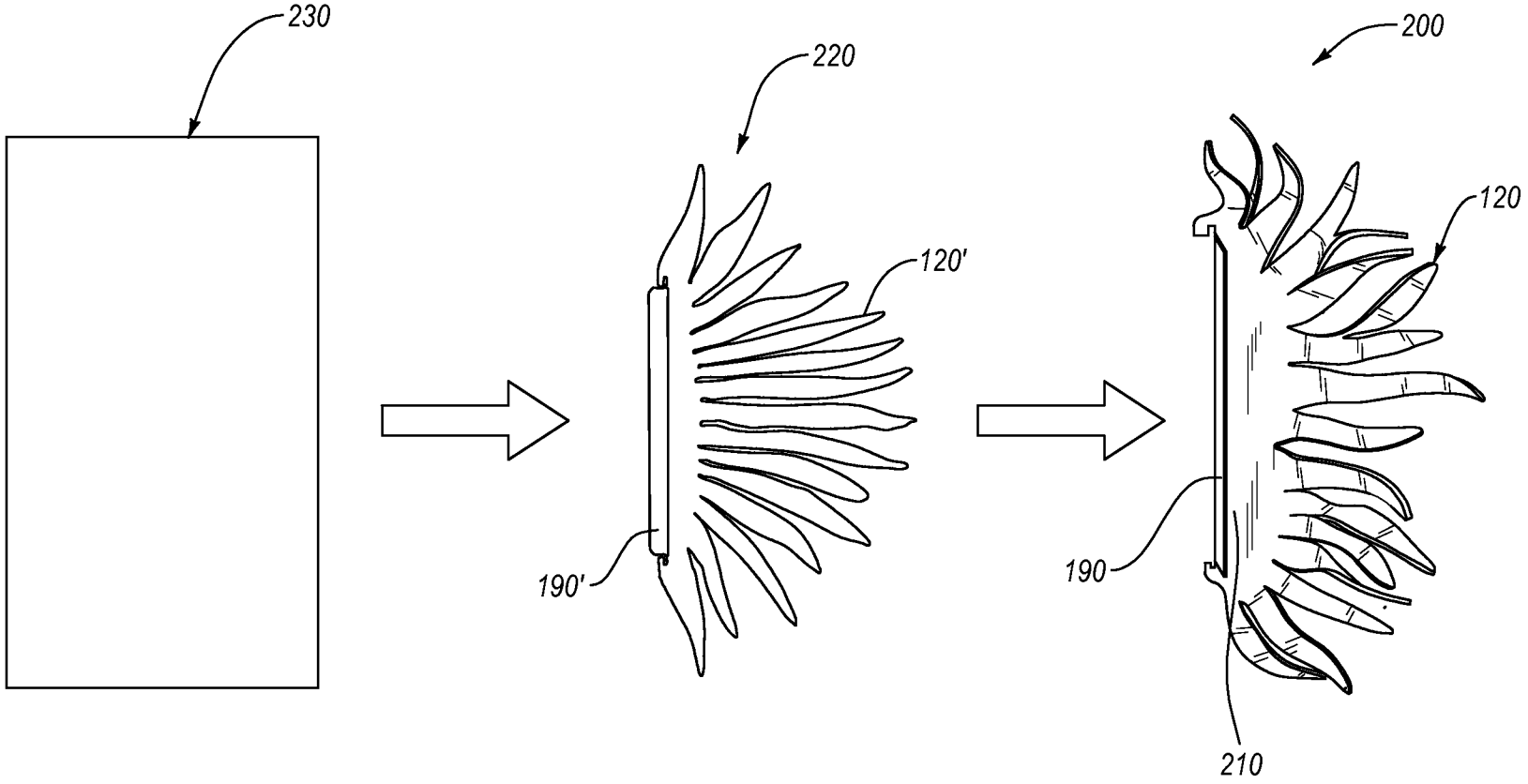
FIG. 3 illustrates acts of a sequence of events in a method of manufacturing resin-based cover panels for a resin-based lighting fixture in accordance with one implementation of the present invention.

To form the resin-based cover panels 200, the manufacturer can cut and form a thermoplastic resin sheet. It should be appreciated that, as noted above, the manufacturer can use a thermoplastic resin sheet that can be a single- or multi-layer thermoplastic resin sheet. For instance, as illustrated in FIG. 3, the manufacturer can cut a two-dimensional blank cutout 220 from a thermoplastic resin sheet 230.

In some implementations, the manufacturer can perform these acts by hand. In alternative implementations, the manufacturer can use a CNC (computer numerically controlled) machine that can maximize the number of two-dimensional blank cutouts 220 cut from each thermoplastic resin sheet 230. In yet further implementations, the two-dimensional blank cutouts 220 can comprise or can be cut from resin scraps from other projects.

As mentioned above, the resin-based cover panel 200 can include the tab 190, the fins 120, and the flat portion 210. Hence, the two-dimensional blank cutout 220 also can include corresponding tab 190', fins 120', and flat portion 210' sections or segments thereof. Thus, the manufacturer can bend, fold, and twist different portions of the two-dimensional blank cutout 220 to form a three-dimensional resin-based cover panel 200.

Specifically, in one implementation, the manufacturer can heat the two-dimensional blank cutout 220 and manually bend, twist, and/or fold the fins 120 section thereof to form the fins 120 of the finished three-dimensional resin-based cover panel 200. Likewise, the manufacturer can bend the tab 190' section thereof to form the tab 190 of the finished three-dimensional resin-based cover panel 200, wherein the tab 190 can have a non-parallel orientation relative to the flat portion 210. Subsequently, the manufacturer can cool the three-dimensional resin-based cover panel 200 (e.g., to room temperature or below glass transition temperature of the thermoplastic material), such that the three-dimensional resin-based cover panel 200 remains substantially rigid.

In light of this disclosure, it should be apparent to those skilled in the art that particular configurations, shapes, colors, and other attributes of the resin-based lighting fixture can vary from one implementation to the next. For instance, FIGS. 4A-4F illustrate a resin-based lighting fixture 100*a* that incorporates resin-based cover panels of various and different colors and designs, which form numerous fins of the resin-based lighting fixture 100*a*. Except as otherwise described herein, the resin-based lighting fixture 100*a* as well as all of the components and elements thereof can be similar to or the same as the resin-based lighting fixture 100 and its respective components and elements.

Figure 4A:
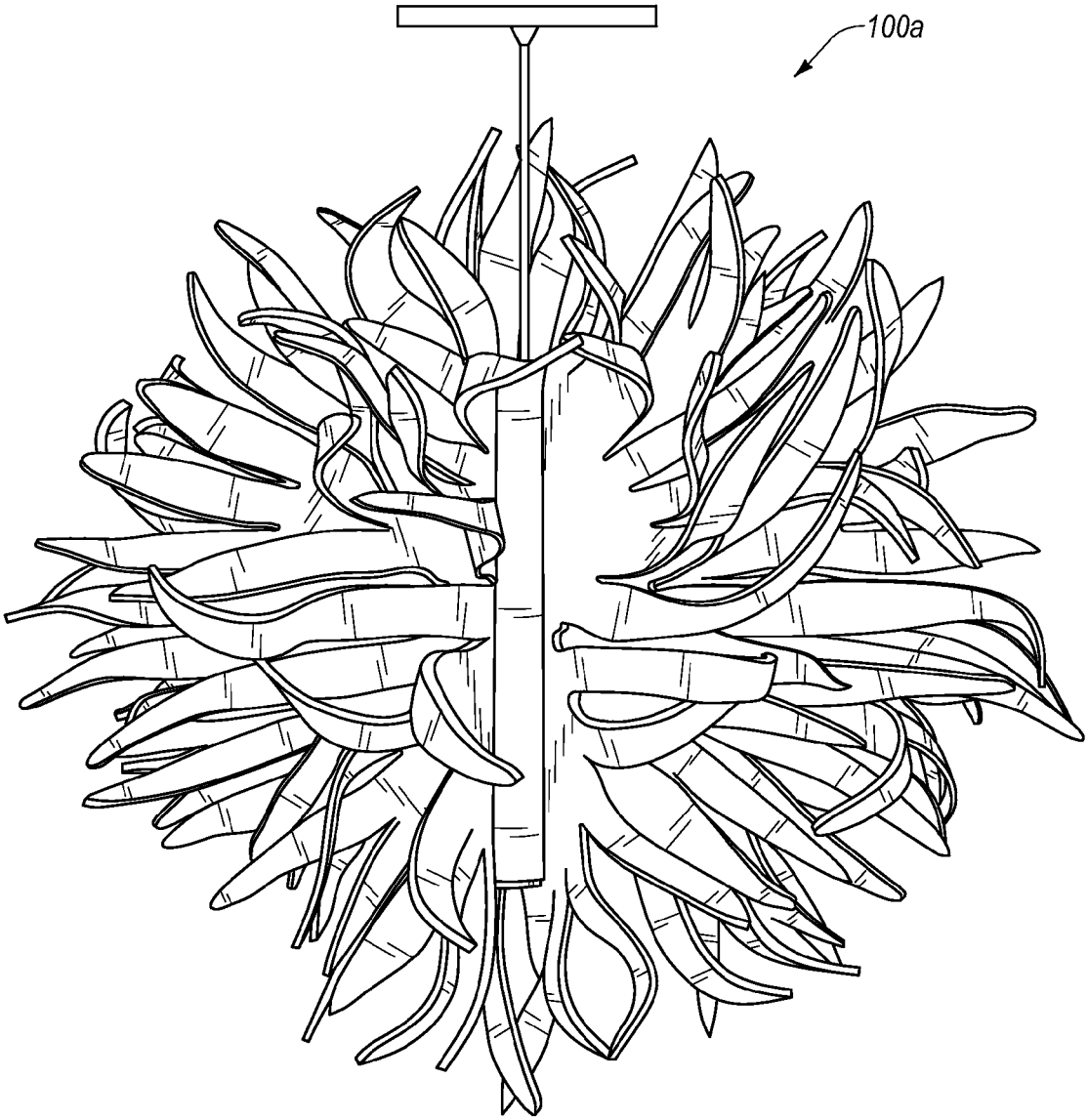
FIG. 4A illustrates a front view of a resin-based lighting fixture in accordance with one implementation of the present invention.
Figure 4B:
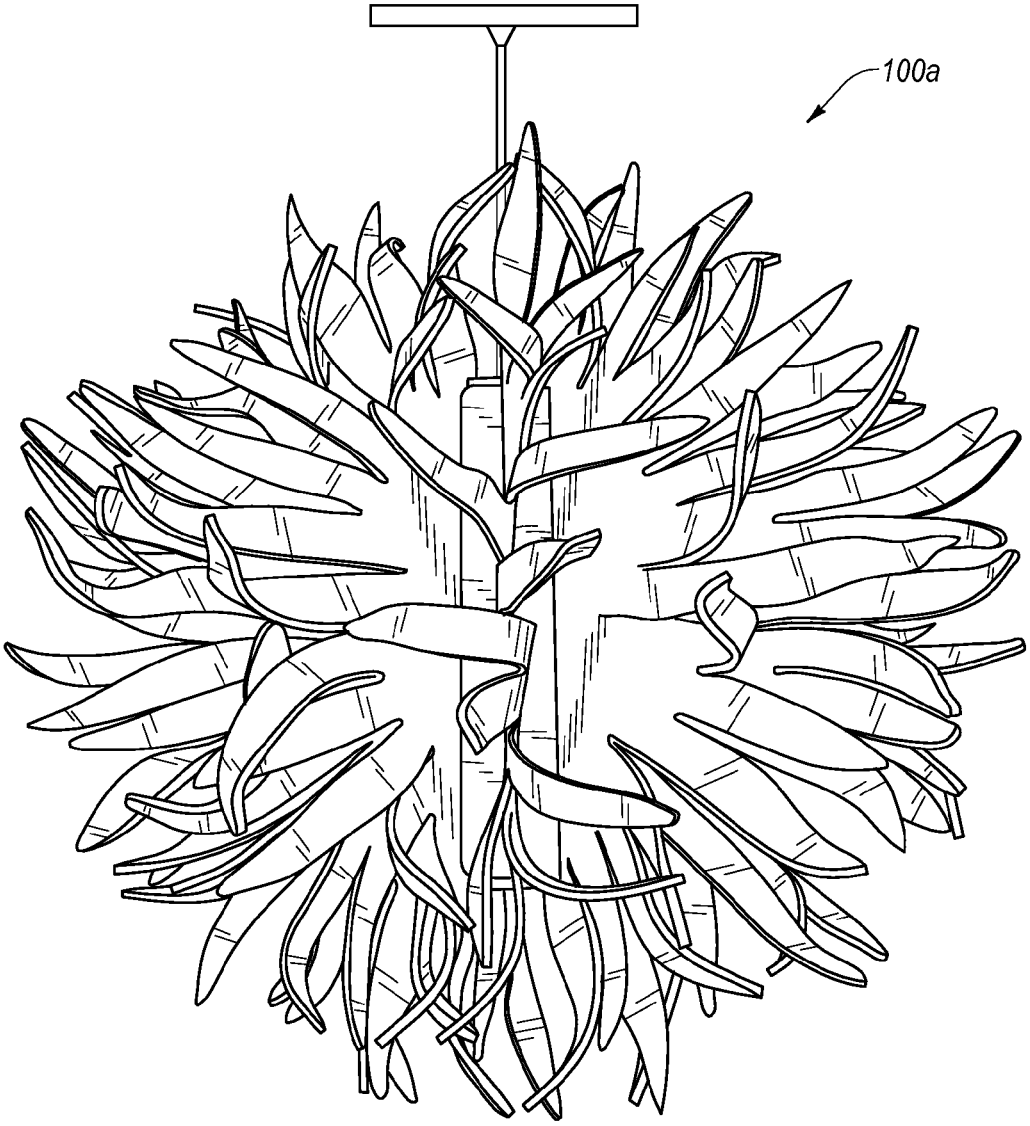
FIG. 4B illustrates a right side view of the resin-based lighting fixture of FIG. 4A.
Figure 4C:
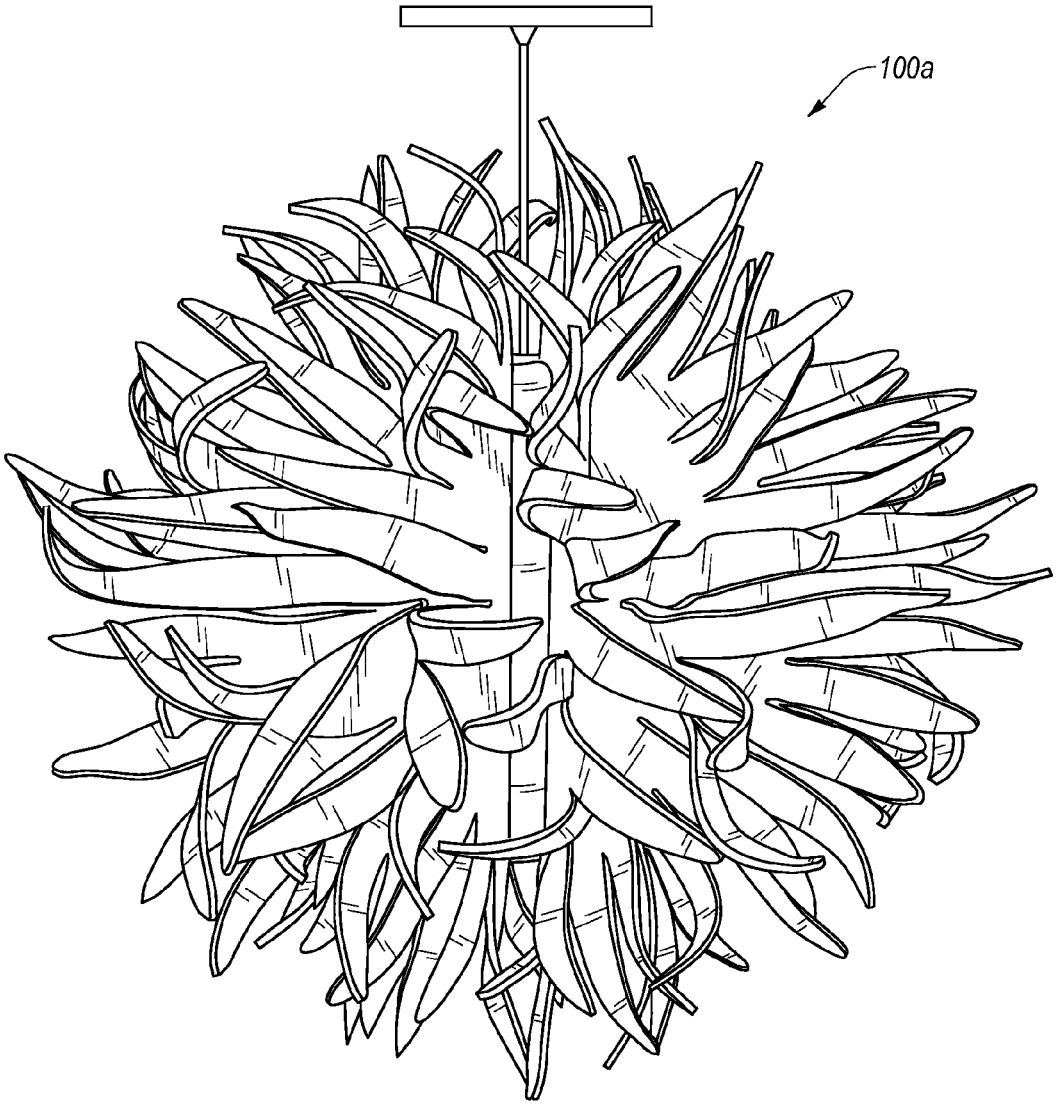
FIG. 4C illustrates a left side view of the resin-based lighting fixture of FIG. 4A.
Figure 4D:
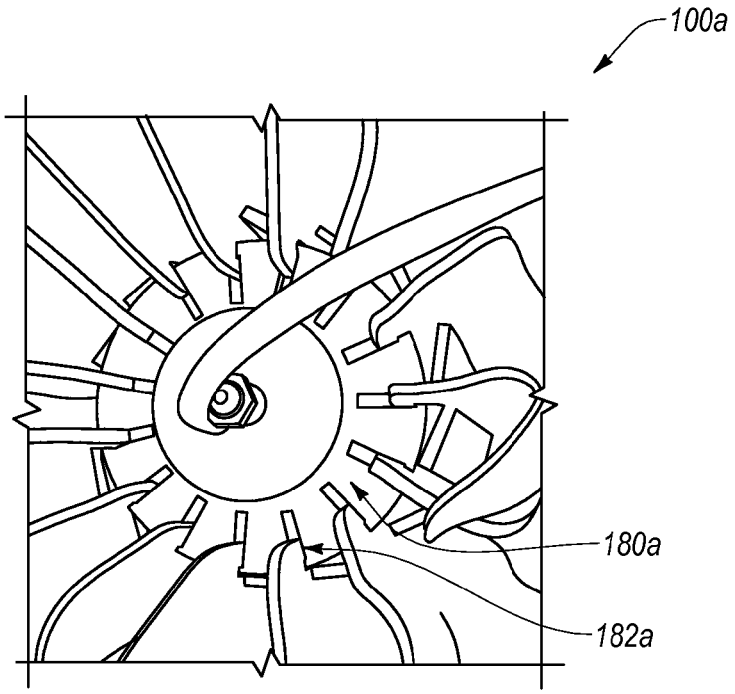
FIG. 4D illustrates a partial top view of the resin-based lighting fixture of FIG. 4A.
Figure 4E:
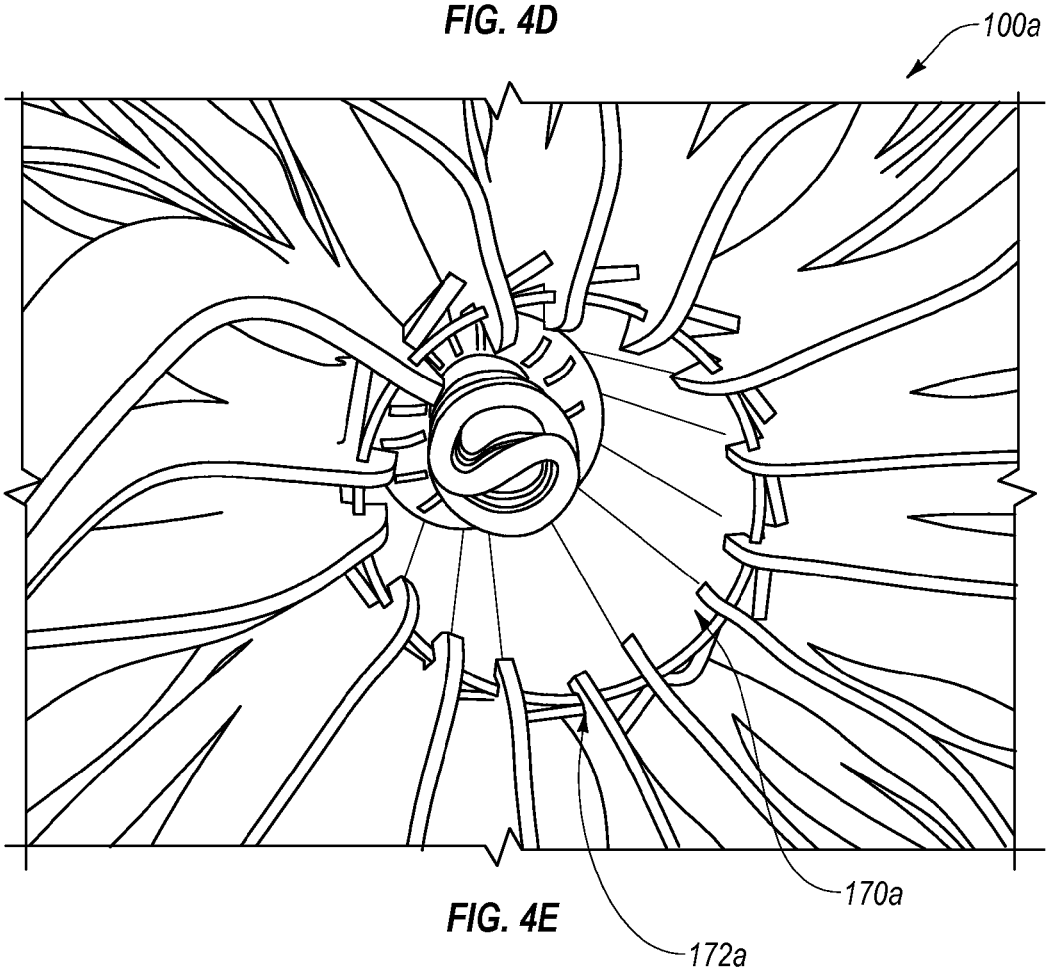
FIG. 4E illustrates a partial bottom perspective view of the resin-based lighting fixture of FIG. 4A.
Figure 4F:
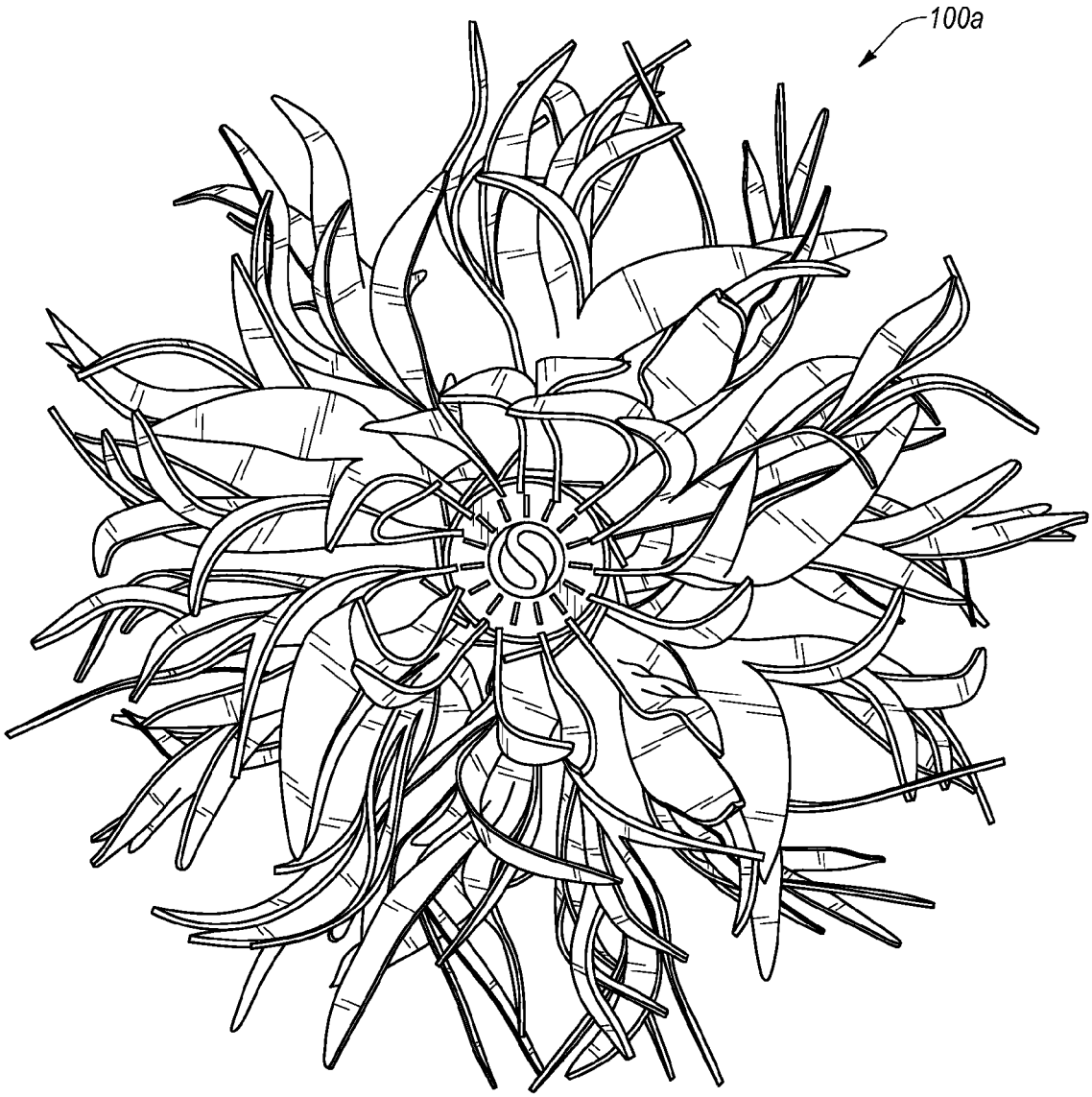
FIG. 4F illustrates a bottom view of the resin-based lighting fixture of FIG. 4A.

For instance, as shown in FIGS. 4A-4C, the resin-based lighting fixture 100*a* has a substantially spherical overall shape defined by the general outline of the numerous fins thereof (although the orientation and alignment of fins 120 provides additional, specific design features). Furthermore, as illustrated in FIG. 4D, the resin-based cover panels can couple within slots 182*a* of a slotted cap 180*a*, which comprises a frame of the resin-based lighting fixture 100*a*. Additionally or alternatively, as illustrated in FIG. 4E, the resin-based cover panels also can couple within channels 172 of a tubular support 170*a* of the frame. In any event, the frame of the resin-based lighting fixture 100*a* can secure the resin-based cover panels.

Moreover, as discussed above and as illustrated in FIG. 4F, the user can easily access and remove and/or replace a lighting element of the resin-based lighting fixture 100*a*. In particular, the frame of the resin-based lighting fixture 100*a* can be hollow, such as to leave the lighting element substantially exposed. Consequently, the user can reach the lighting element from the bottom of the resin-based lighting fixture 100*a* and can easily replace the lighting element without disassembling the resin-based lighting fixture 100*a*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A resin-based lighting fixture configured for simple assembly and redesign, comprising;

a lighted hollow core having an outer surface, a plurality of slots in an upper portion thereof, and a plurality of channels in a lower portion thereof;

a plurality of removable cover panels disposed about the outer surface of the hollow core, wherein the plurality of cover panels conceal the hollow core and provide an aesthetic design to the hollow core;

a diffuser that is integrated with one or more of the removable cover panels disposed about the outer surface of the hollow core; and a lighting element located inside the lighted core; wherein each cover panel of the plurality comprises at least one upper mounting tab and at least one lower mounting tab that correspondingly engage one of the slots in the upper portion or one of the channels in the lower portion, to thereby attach the cover panel to the lighted hollow core.

2. The resin-based lighting fixture as recited in claim 1, wherein:

the upper portion of the hollow core comprises a slotted cap; and the plurality of slots are disposed within the slotted cap.

3. The resin-based lighting fixture as recited in claim 2, wherein the slotted cap is removable from the lighted hollow core.

4. The resin-based lighting fixture as recited in claim 2, wherein:

the slotted cap further comprises a mounting cable attached thereto; and the mounting cable comprises an integrated power cable for powering the lighting element.

5. The resin-based lighting fixture as recited in claim 1, wherein:

the lower portion of the hollow core comprises the plurality of channels formed therein; and the plurality of channels are formed radially about the lower portion.

6. The resin-based lighting fixture as recited in claim 1, wherein the lighted hollow core further comprises a diffuser.

7. The resin-based lighting fixture as recited in claim 6, wherein the diffuser comprises an attached element comprising a resin or fabric.

8. The resin-based lighting fixture as recited in claim 6, wherein the diffuser comprises a texture that has been applied to the lighted hollow core.

9. A resin-based lighting fixture, comprising;

a tubular frame comprising a tubular support having a plurality of slots formed in an upper portion thereof;

a plurality of resin-based cover panels coupled to and about the tubular frame, the resin-based cover panels at least partially concealing the tubular frame and providing a removable design aesthetic to the tubular frame; and a lighting element located inside the tubular frame;

wherein:

each resin-based cover panel comprises at least one upper mounting tab configured to fit within a slot in the upper portion of the tubular frame; and each of the resin-based cover panels comprises a tab that is approximately perpendicular to the corresponding upper mounting tab, and that diffuses light emanating from the tubular frame.

10. The resin-based lighting fixture as recited in claim 9, wherein the lighted hollow core further comprises a diffuser.

11. The resin-based lighting fixture as recited in claim 10, wherein the diffuser comprises an attached element comprising a resin or fabric.

12. The resin-based lighting fixture as recited in claim 10, wherein the diffuser comprises a texture that has been applied to the lighted hollow core.

13. The resin-based lighting fixture as recited in claim 9, wherein:

the upper portion of the tubular frame comprises a slotted cap; and each slot in the upper position is disposed radially within the slotted cap.

14. The resin-based lighting fixture as recited in claim 13, wherein the slotted cap is removable from the lighted hollow core.

15. The resin-based lighting fixture as recited in claim 9, wherein each resin-based cover panel displays a different shape from a next adjacent resin-based cover panel in the plurality.

16. A method for manufacturing a lighting fixture with a variable design aesthetic, comprising:

forming a frame having an upper portion and a lower portion;

forming a plurality of slots for use in the upper portion, wherein the plurality of slots is formed to align circumferentially along the upper portion of the frame;

forming two-dimensional blank cutouts from sheet material;

shaping the two-dimensional blank cutouts into three-dimensional resin-cover panels that comprise at least one upper mounting tab;

securing a first of the shaped resin-cover panels to the frame by inserting the upper mounting tab of the formed resin-cover panel into at least one of the formed slots; and forming a tab having a non-parallel orientation relative to a remainder of the resin-cover panel;

wherein the formed tab diffuses light emanating from the formed frame.

17. The method as recited in claim 16, further comprising forming one or more decorative fins on an end opposite that of the formed, non-parallel tab.

18. The method as recited in claim 16, further comprising securing a second resin-cover panel adjacent the first resin-cover panel by inserting an upper mounting tab of the second resin-cover panel into another of the plurality of slots in the upper portion.

19. The method as recited in claim 16, further comprising:

removing the first resin-cover panel by removing the upper mounting tab thereof from the corresponding slot in the upper portion of the formed frame; and replacing the first resin-cover panel with a new resin-cover panel having a shape that is different from the first resin-cover panel;

wherein the second resin-cover panel changes the overall shape of the lighting fixture.

20. The resin-based lighting fixture as recited in claim 1, wherein the diffuser comprises multiple tabs that surround the lighted core.

21. The resin-based lighting fixture as recited in claim 20, wherein at least one of the tabs of the multiple tabs extends from one of the removable cover panels.

22. The resin-based lighting fixture as recited in claim 21, wherein the at least one tab comprises a portion that:

extends from a flat portion of the removable cover panel; and is oriented in a nonparallel orientation relative to the flat portion.

* * * * *